United States Patent [19]

Nasu

[11] Patent Number: 5,011,502

[45] Date of Patent: Apr. 30, 1991

[54] FUEL ADDITIVES

[76] Inventor: Atsushi Nasu, 99 Katako, Youkaichiba-shi, Chiba-ken, Japan

[21] Appl. No.: 583,143

[22] Filed: Sep. 17, 1990

[51] Int. Cl.[5] ..... C10L 1/32

[52] U.S. Cl. ..... 44/300; 44/451

[58] Field of Search ..... 44/300, 451, 1; 423/104

[56] References Cited

U.S. PATENT DOCUMENTS 12,936 5/1855 Gesner ..... 44/451

4,852,992 8/1989 Nasu ..... 44/300

4,956,157 9/1990 Nasu ..... 423/178

*Primary Examiner*—Margaret B. Medley

*Attorney, Agent, or Firm*—Lorusso & Loud

[57] ABSTRACT

A liquid fuel additives or combustion aid which can be prepared by dissolving solid prepared from seawater and a strong alkali, into a medium miscible with a fuel to which it is applied. The fuel additives can be directly added to petroleum fuels, such as gasoline and light oil, and is usable in all types of combustion engines to improve combustibility, fuel efficiency, etc.

4 Claims, No Drawings

FUEL ADDITIVES

BACKGROUND OF THE INVENTION

1. Field of the Invention:

The present invention relates to fuel additives for improving the thermal efficiency and other properties of petroleum fuel, e.g. gasoline, light oil, etc. In particular, it relates to fuel additives utilizing an alkaline agent and elements contained in seawater.

2. Description of the Prior Art:

In spark-ignition engines, such as automobile engines, a higher compression rate generally brings about a higher thermal efficiency, a greater horsepower and an increase in fuel efficiency. In ordinary gasoline engines, however, an excessively high compression ratio rather causes an undesirable decrease in thermal efficiency because of abnormal combustion or knocking.

High-octane gasoline having good antiknock quality must therefore be used if both high compression rate and high fuel efficiency are to be achieved. However, high-octane gasoline is generally expensive since they are produced by blending various gasoline additives in substantial quantities.

In addition, the oxidation of gasoline results in the generation of high molecular weight gummy substances that cause a lowering in octane value and a marked deterioration in fuel efficiency. Because of this, it is necessary to add an antioxidant to gasoline before it is marketed.

In the case of light oil, a fuel for diesel engines (compression ignition engines), ignitability of the fuel is important along with its stability and fluidity, and hence high-cetane light oil having a high ignitability is required. However, high-cetane light oil is expensive, in comparison with ordinary light oil.

In addition, as in the case of gasoline, the oxidative degradation of light oil results in the formation of high molecular weight gummy substances which, if generated in large quantities, may impede the supply of the fuel and may block fuel injection nozzles. In order to prevent such problems resulting from its degradation, light oil must be subjected to hydrorefining or the like.

The present inventors have found that certain elements and bases contained in seawater exhibit synergistic effects on the improvement of combustibility, and have developed a gasoline modifier utilizing salts separated from seawater (Japanese patent application Laid-open No. 47,492/1989). The modifier is solid and, upon use, charged directly into a fuel contained in a container. However, when dissolved into a fuel, part of the modifier disperses into the fuel in the form of solid particles, which may cause a blocking problem in engines.

The solid separated from seawater is readily soluble in water. It is however difficult to blend the solid per se into such a fuel as gasoline and light oil since it is insoluble in such fuels. It is possible to dissolve the solid into an alcohol. However, in cases where the solid is dissolved into an alcohol and the resulting alcohol solution is added to such a fuel, the desired effect could hardly be obtained since the alcohol solution could hardly be admixed uniformly with the fuel due to difference in their specific gravity.

SUMMARY OF THE INVENTION

It is therefore an object of the present invention to provide fuel additives which can be directly added to such a fuel as gasoline and light oil, so as to improve fuel efficiency, to clean the exhaust gas of combustion system and to increase output.

There are provided by the present invention fuel additives prepared by dissolving solid obtained by (i) acidifying seawater, (ii) adding a strong alkali to the acidified seawater up to a high pH value, (iii) removing precipitates therefrom to obtain a solution and then (iv) removing water from the solution, into a medium miscible with a fuel to which said additives are to be applied.

DETAILED DESCRIPTION OF THE INVENTION

The solid to be used in the present invention can be obtained from seawater in accordance with the following process, as disclosed in U.S. Pat. No. 4,956,157 (corresponding to Japanese patent application Laid-open No. 279,994/1989), entitled "Process for Separating Salts from Seawater."

In the first place, seawater is adjusted to a low pH value with a sulfate ion-containing strong acid. Thereafter, a strong alkali is added thereto up to a high pH value, and then precipitates formed are separated from the solution.

An example of sulfate ion-containing strong acid usable in the process of the invention is diluted sulfuric acid of a concentration of a few percents. It is also possible to use an aqueous solution prepared by adding 3 to 5% of concentrated sulfuric acid to an aqueous solution having dissolved therein activated calcium phosphate, followed by removing precipitates from the resulting mixture (thus obtained aqueous sulfate ion-containing solution will hereinafter be referred to as "P-S Acid"). Although P-S Acid exhibits a strong acidity of a pH of ca. 0.2, it can be quite safe and gives no harm even when attached on the skin, unlike ordinary strong acids, such as sulfuric acid. The pH of seawater can be adjusted to a low pH value of 2.0 or less by adding diluted sulfuric acid or P-S Acid in an amount of a few to several percents, based on seawater, and then allowing the resulting mixture to stand for 2 to 3 hours. In this step, precipitates may be formed in trace quantities, which may be removed by means, e.g., of filtration, together with substances suspended in the original seawater.

Then, strong alkali is used to render the mixture to a high pH value and to precipitate salts, such as sulfates of alkaline earth and other metals, whose solubility decreases at a high pH value. Examples of usable strong alkalis include sodium hydroxide (solid), and an aqueous solution prepared by dissolving sodium hydroxide into an aqueous calcium hydroxide solution (the latter will hereinafter be referred to as "Ca-Na Solution").

Strong alkalis are used in an amount sufficient to achieve the above object. In usual cases, sodium hydroxide (solid) is used in an amount of ca. 3 wt % (based on the weight of seawater), and Ca-Na Solution is used in an amount of ca. 5 wt %, and the pH of seawater is raised to 13 or above. After the addition of strong alkali, the resulting mixture is allowed to stand for 10 hours or more, during which precipitates are deposited.

Thereafter, the precipitates are removed to give Solution (A), which is a basic solution containing alkali metal ions in the same level as in seawater and alkaline earth metal ions, such as Ca and Mg, in quantities less than in seawater. Anions contained in Solution (A) are mostly consisted of hydroxide ions and chlorine ions.

Solution (A) is boiled down to ca. 10 to 15% of its original volume and then cooled to deposit Precipitate (B), which are then removed therefrom to give Solution (D). Subsequently, water contained in Solution (D) is completely removed to obtain desired Solid (C). The result of elementary analysis of Solid (C) is shown in Table 1.

As is apparent from Table 1, Solid (C) is mainly consisted of salts, oxides and hydroxides of Na and Ca, and it exhibits a strong basicity.

It is known that hyperbases, or alkaline earth oxides mixed with metallic Na, are strongly basic and exhibit excellent catalytic activities. Solid (C) presumably contain hyperbases and substances similar to hyperbases in substantial quantities, and its function as fuel modifier is presumably based on the unique characteristics of hyperbases.

TABLE 1

| | wt % | |
|---|---|---|
| Elements | Solid (C) | Precipitate (B) |
| Na | 46.2 | 33.7 |
| Li | 0.008 | 0.0009 |
| K | 1.2 | 0.477 |
| Ca | 0.009 | 0.203 |
| Mg | 0.007 | 6.10 |
| Sr | 0.001 | 0.0194 |
| B | 0.015 | 0.0169 |
| Si | 0.48 | 0.0697 |
| Fe | 0.005 | 0.0018 |
| Al | 0.080 | 0.0034 |
| Cr | 0.001 | 0.0003 |
| Ti | 0.012 | unmeasured |
| Br | 0.020 | unmeasured |
| Cl | 26 | unmeasured |
| S | 2.5 | 3.81 |

The additives according to the present invention can be obtained by dissolving Solid (C) into a medium miscible with a fuel to which said additives are to be applied. It is preferable to use a medium consisting of a mixture of kerosene and one or more alcohols since Solid (C), although it is readily soluble to water and alcohols, is usually hardly soluble in a petroleum fuel, such as gasoline and light oil. When such a medium consisting of a mixture of solvents is employed, the additives can be readily admixed with a fuel into a homogeneous state.

The ratio of kerosene to alcohols, as well as the kind of alcohols to be used, can be varied depending on the kind of fuel to which the additives are applied. It can be particularly preferable to use a medium which contains methyl alcohol and butyl alcohol, together with appropriate amount of kerosene.

It can be advantageous to prepare a concentrate of Solid (C) by kneading Solid (C) together with an alcohol (e.g., methyl alcohol) and then dissolving the kneaded product into a mixture of kerosene and an alcohol or alcohols. Upon use, the concentrate can be diluted with kerosene or other appropriate solvents, depending on the kind of fuel to which it is applied. The final concentration of Solid (C) is preferably from 0.05% to a few percents, although it can be varied depending on the kind of fuel to which it is applied.

The thus obtainable additives according to the present invention can be directly added to a fuel, such as gasoline, heavy oil, light oil, and the like. When added to a fuel, the additives are capable of not only improving combustion efficiency and fuel efficiency, but also reducing the content of harmful gases, such as hydrocarbons and CO, contained in the exhaust.

Because of strong basicity of Solid (C), the additives react with the fuel to form a reaction product, after a while the additives are mixed into the fuel. There in no problem when the additives are applied to directly to burning fuel or the fuel mixed with the additives is applied to boiler, stove or the like. But the reaction product may cause blocking in the fuel applying system of ignition engine, when the fuel is supplied from the fuel tank where the reaction of the fuel and the additives is proceeding. To avoid this blocking, it prefers to adjust a pH of the additives.

An acid mixture developed by the inventor can be used to adjust the pH of the additives. The acid mixture is made by kneading a sintered product with sulfuric acid. The sintered product is obtained by baking the mixture of Precipitate (B) obtained in the procedure separating salts in seawater and calcium compounds consisting of mainly calcium phosphate at high temperature, e.g. more than 1000° C. The acid mixture is mild and readily soluble in the additives and enables to adjust the pH of the additives easily. The precipitate (B), as showed in Table 1, contains mainly Na, Mg, K and Ca and is basic substance.

As the calcium compound sintered together with the precipitate (B), baked animal bones consisting of mainly calcium phosphate can be used. The animal bones are baked at high temperature to remove organic materials and are further baked more than 700° C. The calcium compound and Precipitate (B) are mixed at ratio 2:1–1:2 (by weight) and sintered at high temperature, e.g. 900°–1200° C.

Thus obtained sintered product is kneaded with sulfuric acid at proper ratio to give the acid mixture. Several percent, ca. 1–2% of the kneaded acid mixture is added to the fuel to adjust the pH thereof.

EXAMPLE

The present invention will be further illustrated by way of example.

1. Preparation of P-S Acid

To 1 liter of pure water was dissolved 50 g of powders of baked animal bones consisting mainly of calcium phosphate, to give an aqueous solution having a pH of 13 or above. To this solution was added 5% (based on the weight of the aqueous solution) of concentrated sulfuric acid to produce P-S Acid having a pH of 0.2.

2. Separation of Seawater

To 500 liters of seawater was added 10 liters of P-S Acid prepared above. The resulting mixture was allowed to stand for 3 hours, and then insoluble substances contained therein were removed by filtration. After the filtration, the pH value of the seawater was 1.6. To 500 ml of the resulting seawater was added 15 kg of sodium hydroxide, and the resulting mixture was allowed to stand for 10 hours. Precipitates formed were then filtered off to give Solution (A) having a pH of 13.4.

3. Production of Solid

Ten (10) liters of Solution (A) was heated and water contained therein was evaporated off to give 1.5 liters of concentrate solution. The concentrated solution was cooled rapidly to form precipitates, and the precipitates were removed therefrom to give Solution (B). One liter of Solution (B) was further heated to dryness to give 322 g of Solid (C).

4. Production of Additives

To 300 ml of a mixture of the following solvents:
Methyl alcohol 60 ml
Butyl alcohol 100 ml
Kerosene 140 ml
was added 7.5 g of Solid (C), and the resulting mixture was stirred to give a concentrate of fuel additives.

The concentrated solution was then diluted with kerosene, so as to adjust the concentration of Solid (C) to 1%.

The thus obtained fuel additives according to the present invention was added to kerosene at a concentration of ca. 1% by volume, and the kerosene containing the additives was burned in an oil heater. The unpleasant odor characteristic of kerosene was not generated at all, and the burning was excellent in terms of caloric value.

The residue which remained undissolved at the time when the concentrate of the additives was prepared was directly added to heavy oil, and the heavy oil added with the additives was burned. In this case, too, the burning state of the fuel could be improved.

EXAMPLES 1 and 2

The additives prepared above were added to the fuel of a gasoline engine car (120 ml of additives/60 liters of gasoline) or to the fuel of a diesel engine car (180 ml of additives/60 liters of light oil). The cars were subjected to road test, and the exhaust gas of the gasoline engine car was analyzed. The same tests were performed, using the same cars and the same fuels not added with the additives. Results obtained are shown in Tables 2.

TABLE 2

| | CO (%) | Hydrocarbon (ppm) | Fuel consumption (km/l) |
|---|---|---|---|
| Example 1 (gasoline) | 0.5 | 100 | 11.7 |
| Control 1 | 3.0 | 200 | 9.5 |
| Example 2 (diesel) | — | — | 3.35 |
| Control 2 | — | — | 2.4 |

It would be apparent from the results shown in the tables that the content of CO and hydrocarbons contained in the exhaust from the gasoline engine car could be markedly reduced and that the fuel consumption could be markedly improved in either case. In the case of diesel engine car, the quantity of black smoke could be markedly reduced.

5. Production of Acid mix

Precipitate (B) was heated to dryness to give 200 g of solid. The mixture of the solid (B) and powder of baked animal bones consisting of mainly calcium phosphate at ratio 1:1 was sintered in electric furnace whose temperature was raised gradually and maintained at ca. 1200° C. for about 50 minutes. Acid mixture was gained by kneading 1 g of the sintered material with 1 cc of sulfuric acid. Ten grams of the acid mixture was added to one liter of the concentrated solution described above and the concentrated solution was then diluted with kerosene, so as to adjust the concentration of Solid (C) to 1%.

EXAMPLE 3

0.5 vol % of the additives prepared above were added to the fuel of a gasoline engine car. The car was subjected to road test, and the exhaust gas was analyzed. The same test was performed, using the same car and the same fuel not added with the additives (Control 3). Results obtained are shown in Tables 3.

TABLE 3

| | Amount of Additives (vol %) | CO (%) | HC (ppm) | Fuel Consumption (km/l) |
|---|---|---|---|---|
| Example 3 | 0.5 | 0.025 | 50 | 8.8 |
| Control 3 | 0 | 0.5 | 250 | 6.6 |

EXAMPLE 4 and 5

The additives prepared above were added to the fuel of a diesel engine car (Example 4, 0.5 vol %, Example 5, 1.0 vol %). The car was subjected to road test, and fuel consumption was calculated. A quantity of black smoke of the exhaust gas was measured by determining lightness of filter paper which adsorbed the black smoke of the exhaust gas (deep-black is 100, white is 0). The same test was performed, using the same cars and the same fuels not added with the additives (Control 4). Results obtained are shown in Tables 4.

TABLE 4

| | Amount of Additives (vol %) | Quantity of black smoke | Fuel Consumption (km/l) |
|---|---|---|---|
| Example 4 | 0.5 | 18 | 20.8 |
| Example 5 | 1.0 | 15 | 20.2 |
| Control 4 | 0 | 34 | 14.4 |

In addition to the above, the fuel additives or combustion aid of the invention has the merit that it can be produced at a low cost since it utilizes seawater as a raw material. It can be directly added to fuels and can be used for all types of combustion engines since it is completely free from the blocking problem.

What is claimed is:

1. A fuel additive prepared by (i) acidifying seawater, (ii) adding a strong alkali to the acidified seawater to raise the pH up to a high pH value, (iii) removing precipitates therefrom to obtain a solution and then (iv) removing water from the solution to recover the solids, and dissolving the recovered solids a medium miscible with a fuel to which said additive is to be applied.

2. The fuel additive of claim 1, wherein said medium contains alcohol and kerosene at a predetermined ratio.

3. The fuel additive of claim 1, wherein the pH is further adjusted by adding acid.

4. The fuel additive of claim 3, wherein said acid is a mixture prepared by kneading a sintered material obtained by (i) acidifying seawater, (ii) adding a strong alkali to the acidified seawater to raise the pH to a high pH value, (iii) removing precipitates therefrom to obtain a solution, (iv) cooling the solution to separate out additional precipitates, and then (v) baking the precipitates together with a calcium containing substance consisting mainly of calcium phosphate at high temperature, with sulfuric acid.

* * * * *

UNITED STATES PATENT AND TRADEMARK OFFICE

CERTIFICATE OF CORRECTION

PATENT NO. : 5,011,502

DATED : April 30, 1991

INVENTOR(S) : NASU et al

It is certified that error appears in the above-identified patent and that said Letters Patent is hereby corrected as shown below:

IN THE CLAIMS:

Col. 6, line 49, after "solids" insert --in--.

Signed and Sealed this

Twelfth Day of January, 1993

*Attest:*

DOUGLAS B. COMER

*Attesting Officer*

*Acting Commissioner of Patents and Trademarks*